US008770108B2

(12) United States Patent
Yang et al.

(10) Patent No.: US 8,770,108 B2
(45) Date of Patent: Jul. 8, 2014

(54) COUPLING DEVICE FOR EXPLOSIVES

(75) Inventors: Hyung Sik Yang, Gwangju (KR); Jeong Gyu Kim, Gwangju (KR); Hyong Doo Jang, Jeollanam-do (KR); Won Beom Kim, Gwangju (KR)

(73) Assignee: Industry Foundation of Chonnam National University, Gwangju (KR)

( * ) Notice: Subject to any disclaimer, the term of this patent is extended or adjusted under 35 U.S.C. 154(b) by 97 days.

(21) Appl. No.: 13/530,327

(22) Filed: Jun. 22, 2012

(65) Prior Publication Data

US 2012/0325103 A1 Dec. 27, 2012

(30) Foreign Application Priority Data

Jun. 22, 2011 (KR) ..... 10-2011-0060585
Jun. 1, 2012 (KR) ..... 10-2012-0059188

(51) Int. Cl.
*F42B 3/02* (2006.01)

(52) U.S. Cl.
USPC ..... 102/319; 102/317

(58) Field of Classification Search
USPC ..... 102/317, 331, 313, 314, 319, 320, 323; 285/224, 226, 229, 235, 298, 322, 285/382.4
See application file for complete search history.

(56) References Cited

U.S. PATENT DOCUMENTS

RE21,444 E * 5/1940 Mays ..... 102/319
2,491,692 A * 12/1949 Shimek ..... 166/63
3,057,296 A * 10/1962 Silverman ..... 181/116
3,881,755 A * 5/1975 Brunato ..... 285/123.2
3,926,119 A * 12/1975 Hurst et al. ..... 102/501
4,382,410 A * 5/1983 Bowling et al. ..... 102/310
4,470,352 A * 9/1984 Leperre ..... 102/333
7,210,409 B2 * 5/2007 Johnson ..... 102/317
8,381,653 B2 * 2/2013 Zimmermann ..... 102/313
2011/0297030 A1 * 12/2011 Zimmermann ..... 102/312

FOREIGN PATENT DOCUMENTS

JP 2008-101829 A 5/2008
KR 20-0245825 Y1 8/2001
KR 10-0473597 B1 3/2005
KR 20-0406475 Y1 1/2006

OTHER PUBLICATIONS

International Search Report of PCT/KR2012/004944 mailed on Jan. 17, 2013.

* cited by examiner

*Primary Examiner* — Jonathan C Weber
(74) *Attorney, Agent, or Firm* — Rabin & Berdo, P.C.

(57) ABSTRACT

A coupling device which is configured such that respective explosives for blasting work are coupled to front and rear sections thereof. The coupling device includes cylindrical bodies, one of the bodies being movable away from or close to another one of the bodies, a partition provided inside a predetermined one of the bodies to divide an inner space of the predetermined body, and an expandable support section provided between the bodies to connect the bodies to each other. The expandable support section forms a cylindrical shape together with the bodies when one body is moved away from the other body and is radially expanded when one body is moved close to the other body. The explosives can be easily inserted into a blasting hole and be positioned in the center of the blasting hole, thereby increasing the efficiency of blasting work.

16 Claims, 7 Drawing Sheets

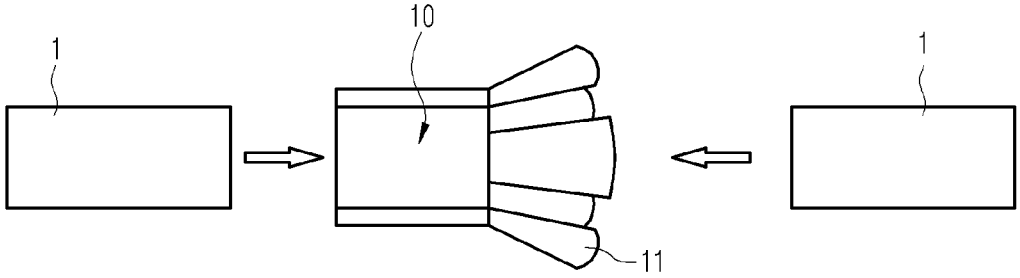
FIG. 1 - PRIOR ART
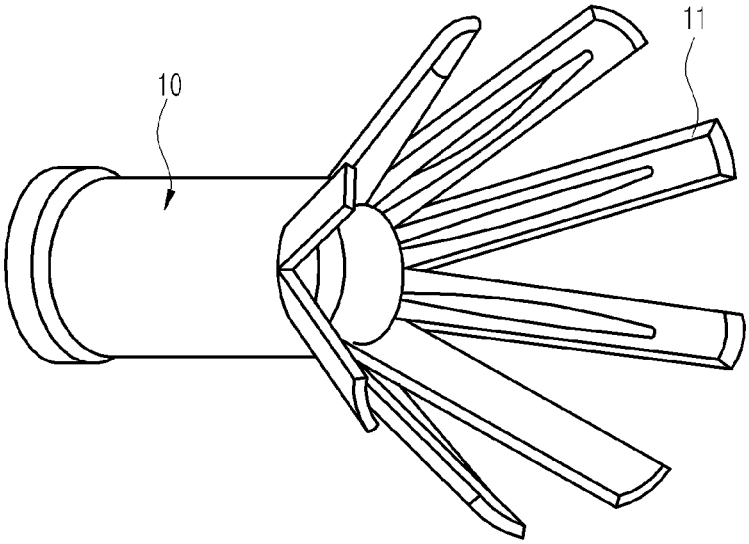
FIG. 2 - PRIOR ART

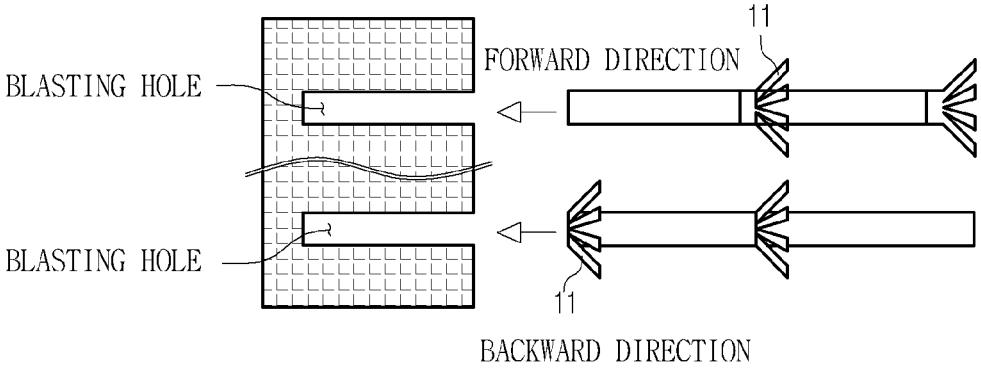
FIG. 3 - PRIOR ART

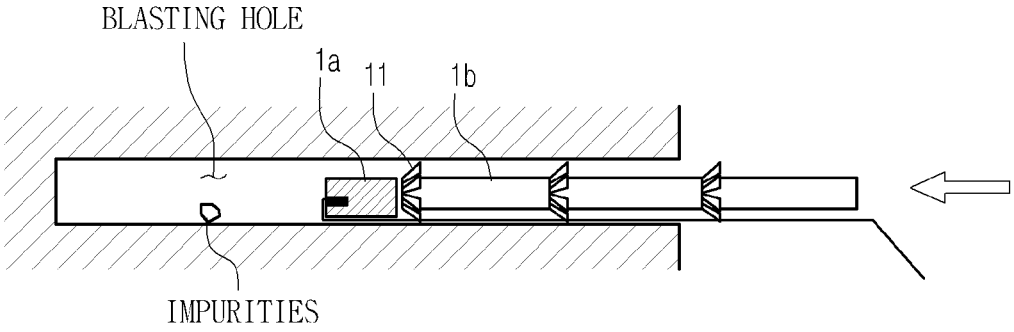
FIG. 4A – PRIOR ART
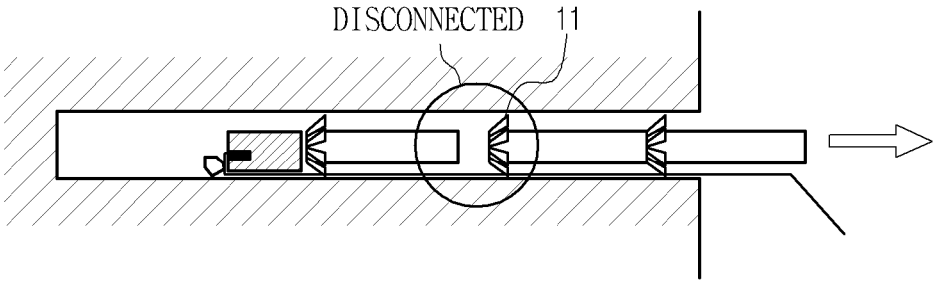
FIG. 4B – PRIOR ART
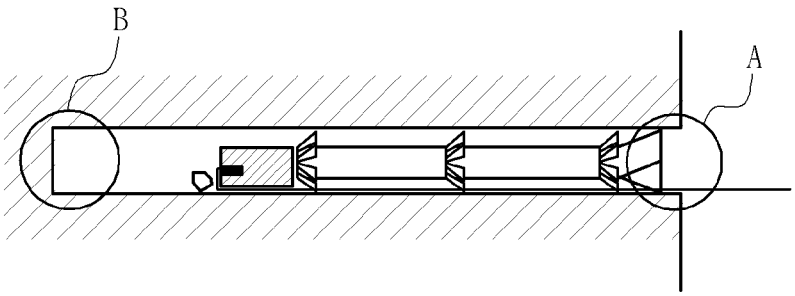
FIG. 4C – PRIOR ART

COUPLING DEVICE FOR EXPLOSIVES

BACKGROUND OF THE INVENTION

1. Field of the Invention

The present invention relates, in general, to a coupling device for explosives, and more particularly, to a coupling device which is configured such that respective explosives for blasting work are coupled to front and rear sections thereof.

2. Description of the Related Art

In a variety of civil engineering and construction work including tunneling work, blasting is performed by forming blasting holes in the ground using a rock drill or the like and then inserting explosives into the blasting holes.

The explosives used in this case are coupled together in line via a coupling device, such as a coupling socket.

Referring to FIG. 1 and FIG. 2, a coupling device 10 for explosives of the related art is provided such that respective explosives 1 for blasting work are coupled to the front and rear sections thereof, and has a plurality of support pieces 11 formed on one portion thereof.

According to the design of the coupling device 10 for explosives of the related art, it is intended to insert the explosives 1 into a blasting hole in the state in which the support pieces 11 are pushed back. However, since it is difficult to insert the explosives into the blasting hole due to friction with the inner surface of the hole, at sites, the designed insertion directions are not followed. Rather, the explosives 1 are inserted in the opposite direction because it is easy.

According to the coupling device 10 for explosives of the related art, there is a problem in that the explosives 1 are not located in the center of the blasting hole and the support pieces 11 are too freely movable. Thus, the explosives 1 may be installed in the state in which they are inclined in one direction, thereby degrading the efficiency of the blasting, which is problematic.

In addition, since it is not easy to insert the explosives 1 into the coupling device 10 because of compressed air, the explosives 1 may be easily detached from the coupling device 10. When the explosives are blown up, the tendency of chain explosion (tendency of sympathetic explosion) is degraded. In addition, there is a possibility that the explosives might fail to explode (misfire).

FIG. 3 is a view showing a method of inserting explosives into a blasting hole of the related art.

Referring to FIG. 3, in the related art, the direction in which the explosives is inserted into a blasting hole may be divided into a forward direction and a backward direction depending on the position of the coupling device. However, the directivity of the forward direction or the backward direction is not essential. The forward direction indicates that the coupling device is positioned on the rear end when the explosives are inserted, whereas the backward direction indicates that the coupling device is positioned on the front end when the explosives are inserted.

First, the forward insertion is a method that is generally used at sites. The explosives can be inserted with no difficulties. If impurities are found in the blasting hole during the insertion, there are no significant difficulties in taking the explosives out in order to inserting them again after removing the impurities.

However, in the forward insertion, accurate centering is difficult because the support pieces of the fastening device are folded. In the case of hardening work, the support pieces are folded and thus do not properly play their role, which is problematic.

Next, the backward insertion is a method in which insertion is performed in such a manner that satisfies the purpose of the manufacture of the coupling device. However, since the coupling device is positioned on the front end, it is difficult to insert the explosives into the blasting hole because of the friction between the wall surface of the blasting hole and the support pieces. After the completion of the insertion, the degree to which the support pieces are bent inside the blasting hole is not as severe as in the forward insertion. However, when the hardening work is performed, as in the forward insertion, it is impossible to prevent the support pieces from being bent.

Furthermore, as shown in FIGS. 4A to 4C, when it is difficult to insert the explosives further due to impurities, such as rock or a tree root, in the blasting hole, it is required to take the coupling device from the blasting hole and insert it again after removing the impurities. However, in the backward insertion, when the coupling device is to be taken out, the support pieces 11 are blocked by the wall surface of the blasting hole. It is therefore substantially impossible to take out the coupling device. When the coupling device is forcibly taken out, the support pieces may be damaged or the explosives may be disconnected from each other (see FIGS. 4A and 4B). In FIG. 4A, reference numeral 1*a* indicates a primary explosive, and reference numeral 1*b* indicates explosives.

When the insertion is difficult due to the impurities or the like, at sites, as shown in FIG. 4C, the operation of inserting the coupling device is stopped, and the remaining explosive, which has not yet been inserted, is forcibly bent and is pushed into the blasting hole (indicated by reference sign 'A'). In this case, however, sealing work (the operation of closing the blasting hole with soil or sand after the completion of the insertion of the explosives) cannot be properly performed since the space is not sufficient for sealing. In addition, inside the blasting hole, the bottom-hole may not be charged (indicated by reference sign 'B'), such that a blown-out shot (the power of explosion leaks directly through the hole) might occur, thereby failing the blasting work.

PRIOR ART REFERENCES

Korean Patent Registration No. 10-0473597 (registration date: 2005 Feb. 17)

Korean utility model Registration NO. 20-0406475 (registration date: 2006 Jan. 11)

SUMMARY OF THE INVENTION

Accordingly, the present invention has been made keeping in mind the above problems occurring in the related art, and a purpose of the present invention is to propose a coupling device for explosives, in which the explosives can be easily inserted into a blasting hole so that they are positioned in the center of the blasting hole, thereby increasing the efficiency of blasting work.

A purpose of the invention is to propose a coupling device for explosives, in which the explosives are prevented from being dislodged due to the coupling state being enhanced.

Furthermore, a purpose of the invention is to propose a coupling device for explosives, in which compressed air pressure that is generated when the explosives are coupled to the coupling device is decreased, thereby improving the tendency of chain explosion (tendency of sympathetic explosion) and increasing the efficiency of blasting work.

In order to achieve the above object, according to one aspect of the present invention, there is provided a coupling device which is configured such that respective explosives for blasting work are coupled to front and rear sections thereof. The coupling device includes cylindrical bodies, one of the bodies being movable away from or close to another one of the bodies; a partition provided inside a predetermined one of the bodies, the partition dividing an inner space of the predetermined body; and an expandable support section provided between the bodies to connect the bodies to each other. The expandable support section forms a cylindrical shape together with the bodies when one of the bodies is moved away from the other one of the bodies and is radially expanded when one of the bodies is moved close to the other one of the bodies.

In an exemplary embodiment, the expandable support section may include a plurality of support pieces, which are arranged in an outer circumferential direction of the bodies and are cut in a lengthwise direction of the bodies. Each of the support pieces may be symmetrical such that the support piece is foldable in a middle portion thereof.

In an exemplary embodiment, the expandable support section may further include anti-folding projections provided between the support pieces and the bodies.

In an exemplary embodiment, the anti-folding projections may also be formed on an inner middle portion of the support pieces at which the support pieces are to be folded.

In an exemplary embodiment, an air vent may be formed in one of the bodies that has sections divided by the partition, the air vent being formed in at least one of the sections divided by the partition, such that air can be exhausted from inside the bodies when the explosives are inserted into and coupled to the bodies.

In an exemplary embodiment, each of the bodies has an engagement recess in an inner surface thereof, the engagement recess fixing a corresponding one of the explosives, which is inserted into and coupled to the body, from the outside.

In an exemplary embodiment, the coupling device may further include a holding protrusion extending from the partition. The holding protrusion is provided inside the predetermined body and fixes a corresponding one of the explosives, which is inserted into and coupled to the predetermined body.

And, in an exemplary embodiment, the expandable support section further comprises a wall-fixing tap, which protrudes out from a folding portion of the support pieces, more preferably, the wall-fixing tap has a contact surface that can come into face-to-face contact with an inner wall of a blasting hole in a state in which the support pieces are folded.

And, in an exemplary embodiment, each of the bodies has a plurality of grooves longitudinally formed in an inner wall thereof.

And, in an exemplary embodiment, the holding protrusion has a through-hole formed therein.

Consequently, according to embodiments of the invention, the coupling device enables the explosives to be easily inserted into a blasting hole so that they are positioned in the center of the blasting hole, thereby increasing the efficiency of blasting work.

In addition, according to embodiments of the invention, since the coupling state is enhanced by the coupling device, the explosives are prevented from being dislodged.

Furthermore, according to embodiments of the invention, the coupling device decreases compressed air pressure that is generated when the explosives are coupled to the coupling device, thereby improving the tendency of chain explosion (tendency of sympathetic explosion) and increasing the efficiency of blasting work.

BRIEF DESCRIPTION OF THE DRAWINGS

The above and other objects, features and further advantages of the present invention will be more clearly understood from the following detailed description when taken in conjunction with the accompanying drawings, in which:

FIG. 1 is a side elevation view showing the structure in which a coupling device for explosives is coupled with explosives;

FIG. 2 is a perspective view of the coupling device for explosives according to the related art;

FIG. 3 is a view showing a method of inserting explosives into a blasting hole of the related art;

FIGS. 4A, 4B and 4C are views showing a method of inserting explosives in a backward direction according to the related art;

DETAILED DESCRIPTION OF THE INVENTION

The present invention will be described in detail hereinafter with reference to the accompanying drawings.

Figure 5:
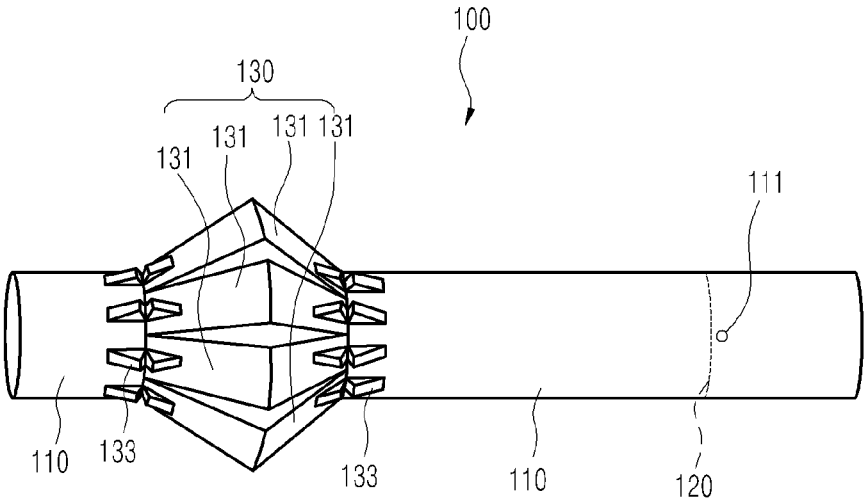
FIG. 5 is a perspective view of a coupling device for explosives according to the invention.
Figure 6:
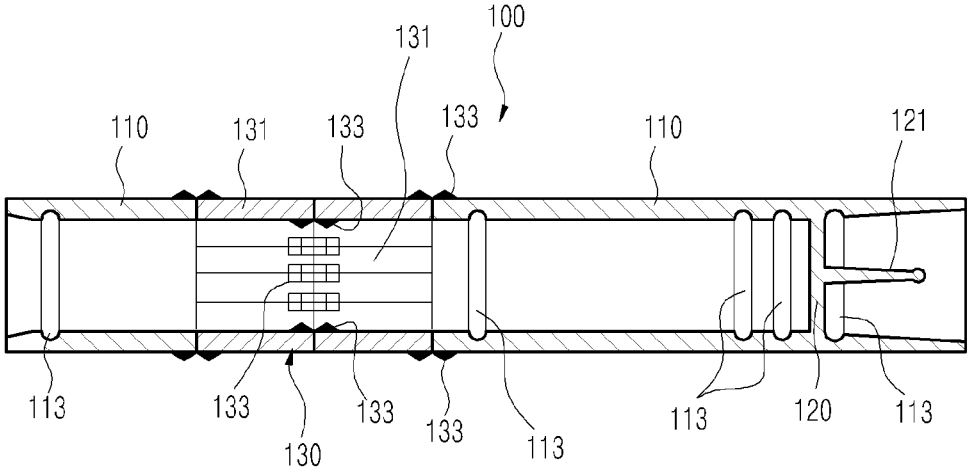
FIG. 6 is a side elevation view of the coupling device for explosives shown in FIG. 5.

In a variety of civil engineering and construction work including tunneling work, in order to perform blasting work, a blasting hole is formed in the ground using a rock drill or the like, and explosives 1 are inserted into the blasting hole. In this case, as shown in FIG. 6, a coupling device 100 for explosives (hereinafter, referred to as an 'explosive-coupling device') according to an embodiment of the invention is configured such that the respective explosives 1 are coupled to the front and rear sections thereof, and are connected in line. The explosive-coupling device 100 serves to guide the explosives 1 to be inserted into the center of the blasting hole. As shown in FIG. 5 and FIG. 6, the coupling device 100 includes bodies 110, a partition 120, and an expandable support section 130.

As shown in FIG. 5, the bodies 110 have a cylindrical shape. A plurality of bodies 110 are provided such that one of the bodies is brought away from or close to the other one of bodies.

As shown in FIG. 6, the partition 120 is provided inside one of the bodies 110 such that the inner space of that body is partitioned and isolated.

As shown in FIG. 5, the expandable support section 130 is provided between the bodies 110 such that it connects the bodies 110 to each other. As shown in FIG. 6, when one of the bodies 110 is brought away from the other of the bodies 110, the expandable support section 130 is converted into a cylindrical shape together with the bodies 110. As shown in FIG. 5, when one of the bodies 110 is brought close to the other body 110, the expandable support section 130 is radially expanded.

In more detail, as shown in FIG. 5 and FIG. 6, the expandable support section 130 includes a plurality of support pieces 131, which are arranged in the outer circumferential direction of the bodies 110 and are cut from each other in the lengthwise direction. Each support piece 131 is formed symmetrically such that the middle portion thereof can be folded. Accordingly, when the bodies 110 are brought close to each other, all of the support pieces 131 are folded on the side so that the expandable support section 130 is radially expanded when viewed from the front.

When the plurality of explosives 1 are connected together by the explosive-coupling device 100 of the invention and are then inserted into the blasting hole, all of the support pieces 131 of the expandable support section 130 are spread in the horizontal direction between the bodies 110 and form a cylindrical shape together with the bodies 110. In this state, the explosive-coupling device 100 and the explosives 1 are inserted into the blasting hole. When hardening work is performed for blasting work, the interval between the bodies 110 inside the blasting hole is decreased so that all of the support pieces 131 are folded such that the expandable support section 130 is radially expanded and is thus firmly fixed in the center of the blasting hole.

In this way, due to the expandable support section 130, the explosives 1 coupled to the explosive-coupling device 100 can be easily inserted into the blasting hole and be located in the center of the blasting hole, thereby increasing the efficiency of the blasting work. In addition, since the expandable support section 130 is radially expanded by the hardening work after being inserted into the blasting hole, the explosives 1 coupled to the explosive-coupling device 100 are strongly supported by the expandable support section 130 inside the blasting hole so as to not move from the center of the blasting hole, thereby further increasing the effect of decoupling blasting.

In an embodiment of the invention, as shown in FIG. 5, it is preferred that the expandable support section 130 further includes anti-folding projections 133 provided between the support pieces 131 and the bodies 110.

Accordingly, the support pieces 131 of the expandable support section 130 are prevented from being bent at a predetermined angle or more by the anti-folding projection 133, thereby further increasing the supporting force that the expandable support section 130 provides. The expandable support section 130 can be uniformly expanded in the radial direction so that the explosive-coupling device 100 does not move inside the blasting hole.

As shown in FIG. 6, the anti-folding projections 133 are preferably provided on the inner middle portion of the support pieces 131 at which the support pieces 131 are to be folded.

As shown in FIG. 5, an air vent 111 is formed in one of the bodies 110 that has the partition, more particularly, in at least one of the sections of the body 110 divided by the partition 120, such that air can be exhausted from the inside of the bodies when the explosives 1 are inserted into and coupled to the bodies 110.

In an embodiment of the invention, the air vent 111 is preferably formed at a position close to the partition 120.

Accordingly, when the explosives 1 are inserted into the explosive-coupling device 100 of the invention via interference fitting or the like, the air between the partition 120 and a corresponding explosive 1 inside the body 110 is exhausted through the air vent 111 to the outside. This decreases compressed air pressure that is generated when the explosive 1 is coupled to the explosive-coupling device 100, so that the explosive 1 can be easily inserted into the explosive-coupling device 100. In addition, the speed of blasting is uniformly delivered, thereby improving the tendency of chain explosion (tendency of sympathetic explosion) and increasing the efficiency of the blasting work.

In addition, as shown in FIG. 6, the bodies 110 have engagement recesses 113 in the inner surface thereof. The engagement recesses 113 fix the explosives 1, which are inserted into and coupled to the bodies 110, from the outside.

In an embodiment of the invention, as shown in FIG. 6, a plurality of engagement recesses 113 is formed by depressing the inner surface of the bodies 110 such that the engagement recesses 113 correspond to the shape of the explosives 1 such that protrusions on the outer surface of the explosives 1 can be engaged and coupled with the recesses 113. In particular, it is preferred that the engagement recesses 113 be formed in the front and rear areas with respect to the partition 120.

Accordingly, since the protrusions of the explosives 1 are engaged and coupled with the engagement recesses 113 of the explosive-coupling device 100 via interference fitting, the state in which the explosives 1 are coupled by the explosive-coupling device 100 becomes stronger, thereby preventing the explosives 1 from being dislodged.

In an embodiment of the invention, it is preferred that a explosive 1, which is to be inserted into the front section of the explosive-coupling device 100, have a recess in the rear end thereof, such that the recess extends across the rear end. Due to this, in the case of inserting the explosive 1 into the front section of the explosive-coupling device 100, if the inside of the explosive-coupling device 100 is closed with impurities, such as soil or sand, the explosive 1 can be easily taken out, and the impurities can be removed from the inside of the explosive 1. Then, the explosive 1 can be coupled to the explosive-coupling device 100.

Here, a plurality of engagement recesses 113 are provided. In particular, it is preferred that a pair of engagement recesses 113 be formed in the front section of the partition 120. Accordingly, once the explosive 1 is inserted into the front section of the explosive-coupling device 100 and is moved to the end until the protrusion of the explosive 1 is engaged with the engagement recess 113, the explosive 1 can be strongly coupled to and is not easily released from the explosive-coupling device 100.

Figure 7:
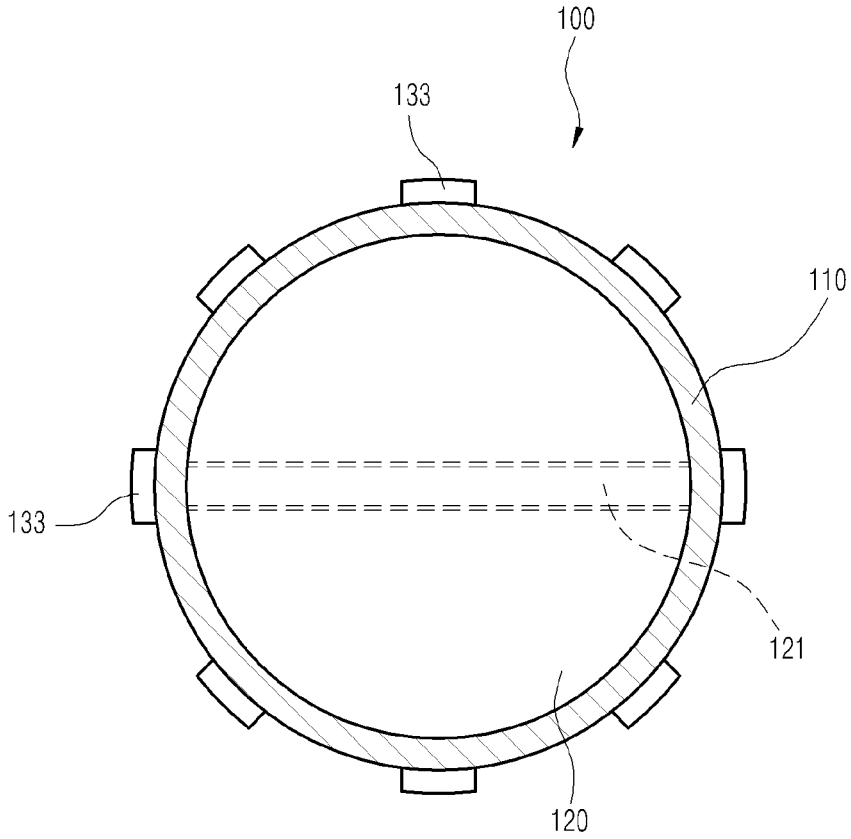
FIG. 7 is a front elevation view of the coupling device for explosives shown in FIG. 5.
Figure 8:
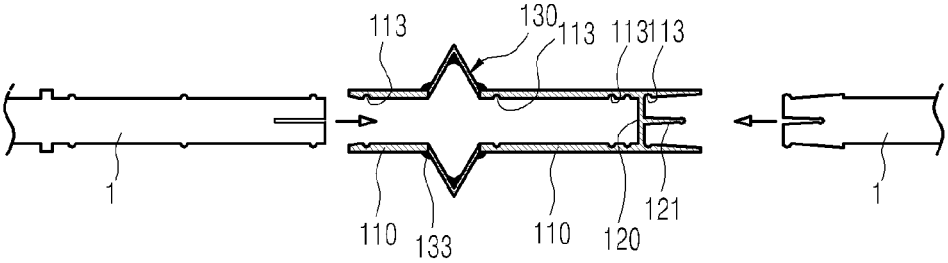
FIG. 8 is a side elevation view showing the structure in which the coupling device for explosives shown in FIG. 5 is coupled with explosives.

In an embodiment of the invention, as shown in FIG. 6 and FIG. 7, it is preferred that the explosive-coupling device 100 also includes a holding protrusion 121 extending from the partition 120. The holding protrusion 121 is formed inside the device, and fixes the explosive 1 which is inserted into and coupled to the body 110.

Accordingly, when coupling the explosive 1 to the explosive-coupling device 100, one end area of the explosive 1 is spread by the holding protrusion 121 while one portion of the explosive 1 that protrudes from the outer surface thereof is firmly engaged with the engagement recess 113. Thus, the coupling between the explosive 1 and the explosive-coupling device 100 can be stronger so as to not be dislodged. The explosive 1 can be inserted into the end of the explosive-coupling device 100 and be completely coupled to the explosive-coupling device 100, thereby further increasing the effect of the blasting process.

In this structure, the explosives 1 are coupled to the explosive-coupling device 100 of the invention and are inserted into the blasting hole by the following process, which will be described below with reference to FIG. 5 to FIG. 7.

First, one explosive 1 is coupled to the front section of the explosive-coupling device 100. Here, the explosive 1 is coupled to the front section of the explosive-coupling device 100 in the state in which all of the support pieces 131 of the expandable support section 130 are horizontally spread between the bodies 110 and form a cylindrical shape together with the bodies 110. When the explosive 1 is being coupled, the rear end of the explosive 1 is inserted into the insert opening of one of the bodies 110 and then passes through the expandable support section 130 until it meets the partition 120, which is provided inside the other body 110.

Afterwards, another explosive 1 is coupled to the rear section of the explosive-coupling device 100. Here, the recess formed in the front end of the explosive 1 that is to be coupled is spread by the holding protrusion 121, which extends from the partition 120, as the explosive 1 is gradually inserted. When the front end of the explosive 1 is completely inserted into the partition 120, the protrusion on the outer surface of the explosive 1 is firmly engaged with the engagement recess 113.

After that, the explosive-coupling device 100 together with the explosives 1, which are coupled to the front and rear sections thereof, is inserted into a blasting hole, and then a hardening work is performed so that the support pieces 131 of the expandable support section 130 are folded and thus the expandable support section 130 is radially expanded.

Accordingly, in the present invention, the explosive-coupling device 100 to which the explosives 1 are coupled can be easily inserted into the blasting hole in the state in which the expandable support section 130 forms a cylindrical shape together with the bodies 110. Due to the hardening work, the expandable support section 130 is radially expanded inside the blasting hole and firmly supports the explosives 1, which are coupled to the explosive-coupling device 100, so that the explosive-coupling device 100 to which the explosives 1 are coupled does not move from the center of the blasting hole. In this way, it is possible to increase the efficiency of the blasting work. In addition, after the explosive-coupling device 100 is inserted into the blasting hole, when it is required to take out the explosive-coupling device 100 because of the presence of impurities, the operation of taking out the device is easy.

Figure 9A:
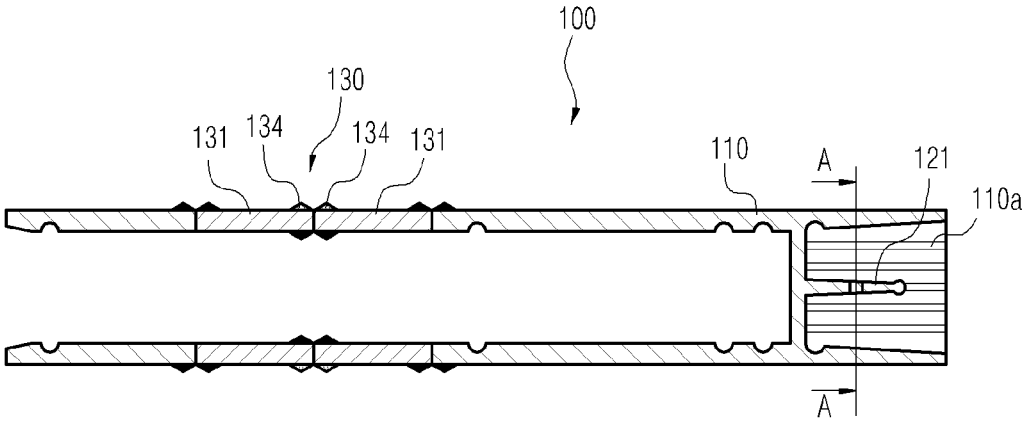
FIGS. 9A and 9B are side elevation views of a coupling device for explosives according to another embodiment of the invention.
Figure 9B:
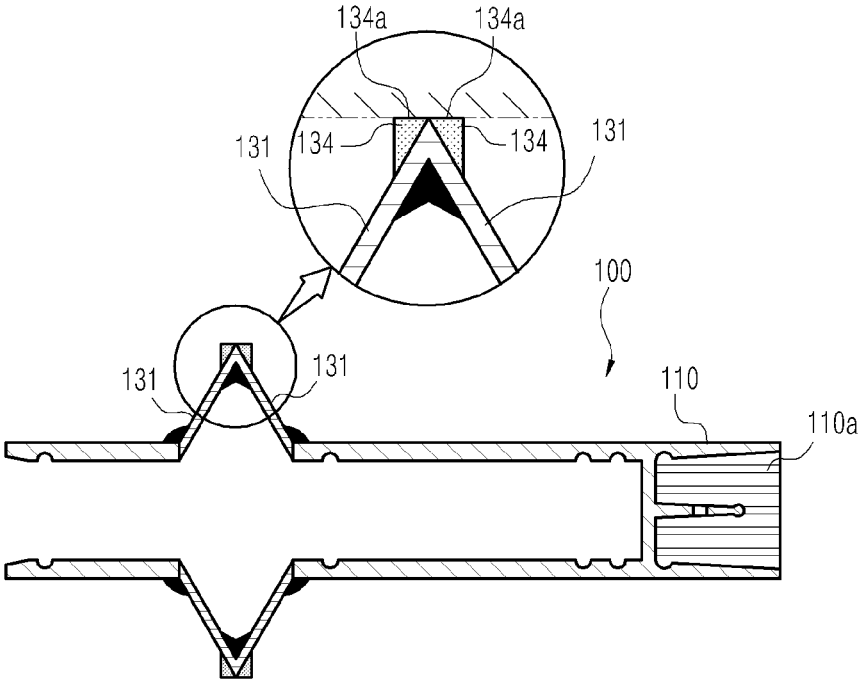
Figure 10:
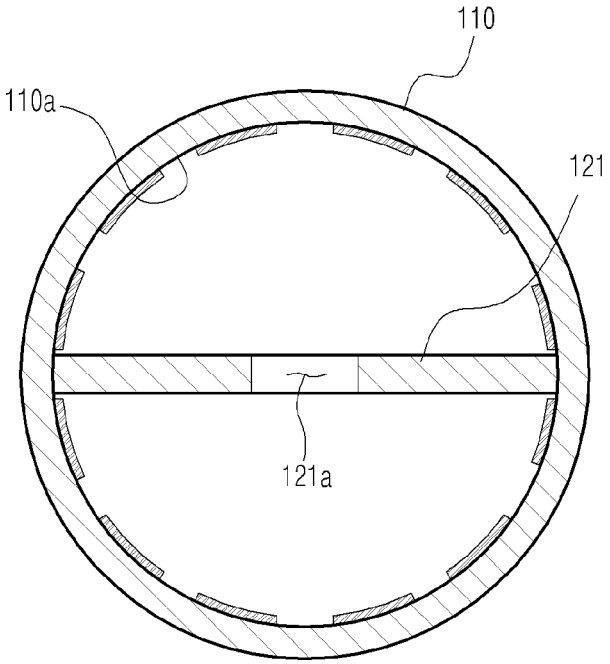
FIG. 10 is a cross-sectional view taken along line A-A in FIG. 9A.

FIGS. 9A and 9B are side elevation views of a coupling device for explosives according to another embodiment of the invention, and FIG. 10 is a cross-sectional view taken along line A-A in FIG. 9A.

In the explosive-coupling device 100 of this embodiment, the expandable support section 130 may also include wall-fixing taps 134, which protrude out from a folding portion of the support pieces 131. Preferably, each wall-fixing tap 134 has a contact surface 134*a* that can come into face-to-face contact with the inner wall of the blasting hole in the state in which the support pieces 131 are folded.

When examining the site after blasting, a explosive that is out of the blasting hole is sometimes found. This may occur when sympathetic explosion did not take place in explosives, which are loaded in outer holes. This may occur in the tunnel blasting when gas pressure, which is generated by the detonation of front-row holes (holes which are exploded prior to the outer holes), is transferred between the joint or gap, thereby causing the explosives inserted into the outer holes to pop out of the blasting holes.

In order to prevent this, it is preferred that the coupling device is provided with a means for firmly supporting the coupling device inside the blasting hole. In this embodiment, the wall-fixing taps 134 provided on the support pieces 131 can play such role.

In the state in which the coupling device 100 is inserted into the blasting hole and the support pieces 131 are folded due to the hardening work, the wall-fixing taps 134 and the inner wall of the blasting hole are in face-to-face contact, which causes strong frictional force, thereby minimizing the explosives from popping out during the blasting.

In addition, in the coupling device 100 of the invention, the body 110 may also have a plurality of grooves 110*a* longitudinally formed in the inner wall thereof. Then, the compressed air, which can be generated inside the body 110 when the bodies 110 and the explosives 1 are assembled together, can be exhausted to the outside along the grooves 110*a*, so that the coupling device 100 and the explosives 1 can be easily assembled together.

In addition, as shown in FIG. 10, as another example of such means, a through-hole 121*a* may also be formed in the holding protrusion 121, which is provided inside the body 110 and protrudes in order to be assembled with the explosive. The through-hole 121*a* is formed such that it can decrease compressed air pressure that can be generated inside the body 110 when the body 110 is assembled with the explosive.

Although a preferred embodiment of the present invention has been described for illustrative purposes, those skilled in the art will appreciate that various modifications, additions and substitutions are possible, without departing from the scope and spirit of the invention as disclosed in the accompanying claims. For example, it should be understood that the explosive in a preferred embodiment of the present invention can be various kinds of well-known explosives.

What is claimed is:

1. A coupling device which is configured such that respective explosives for blasting work are coupled to front and rear sections thereof, the coupling device comprising:

cylindrical bodies, one of the bodies being movable away from or close to another one of the bodies;

a partition provided inside a predetermined one of the bodies, the partition dividing an inner space of the predetermined body; and an expandable support section provided between the bodies to connect the bodies to each other, wherein the expandable support section forms a cylindrical shape together with the bodies when one of the bodies is moved away from the other one of the bodies and is radially expanded when one of the bodies is moved close to the other one of the bodies.

2. The coupling device of claim 1, wherein the expandable support section comprises a plurality of support pieces, which are arranged in an outer circumferential direction of the bodies and are cut in a lengthwise direction of the bodies, wherein each of the support pieces is symmetrical such that the support piece is foldable in a middle portion thereof.

3. The coupling device of claim 2, wherein the expandable support section further comprises anti-folding projections provided between the support pieces and the bodies.

4. The coupling device of claim 3, wherein the anti-folding projections are also formed on an inner middle portion of the support pieces at which the support pieces are to be folded.

5. The coupling device of claim 4, further comprising a holding protrusion extending from the partition, the holding protrusion provided inside the predetermined body to fix a corresponding one of the explosives, which is inserted into and coupled to the predetermined body.

6. The coupling device of claim 3, further comprising a holding protrusion extending from the partition, the holding protrusion provided inside the predetermined body to fix a corresponding one of the explosives, which is inserted into and coupled to the predetermined body.

7. The coupling device of claim 2, wherein the expandable support section further comprises a wall-fixing tap, which protrudes out from a folding portion of the support pieces.

8. The coupling device of claim 7, wherein the wall-fixing tap has a contact surface that can come into face-to-face contact with an inner wall of a blasting hole in a state in which the support pieces are folded.

9. The coupling device of claim 2, further comprising a holding protrusion extending from the partition, the holding protrusion provided inside the predetermined body to fix a corresponding one of the explosives, which is inserted into and coupled to the predetermined body.

10. The coupling device of claim 1, wherein an air vent is formed in one of the bodies that has sections divided by the partition, the air vent being formed in at least one of the sections divided by the partition, such that air can be exhausted from inside the bodies when the explosives are inserted into and coupled to the bodies.

11. The coupling device of claim 10, further comprising a holding protrusion extending from the partition, the holding protrusion provided inside the predetermined body to fix a corresponding one of the explosives, which is inserted into and coupled to the predetermined body.

12. The coupling device of claim 1, wherein each of the bodies has an engagement recess in an inner surface thereof, the engagement recess fixing a corresponding one of the explosives, which is inserted into and coupled to the body, from outside.

13. The coupling device of claim 12, further comprising a holding protrusion extending from the partition, the holding protrusion provided inside the predetermined body to fix a corresponding one of the explosives, which is inserted into and coupled to the predetermined body.

14. The coupling device of claim 1, further comprising a holding protrusion extending from the partition, the holding protrusion provided inside the predetermined body to fix a corresponding one of the explosives, which is inserted into and coupled to the predetermined body.

15. The coupling device of claim 14, wherein the holding protrusion has a through-hole formed therein.

16. The coupling device of claim 1, wherein each of the bodies has a plurality of grooves longitudinally formed in an inner wall thereof.

* * * * *